US006990047B1

(12) United States Patent
Barbagiovanni et al.

(10) Patent No.: US 6,990,047 B1
(45) Date of Patent: Jan. 24, 2006

(54) METHOD TO TRACK USING A LOCATOR DEVICE

(76) Inventors: Joseph Barbagiovanni, 82 Ohio Ave., Congers, NY (US) 10929; Carmela Barbagiovanni, 82 Ohio Ave., Congers, NY (US) 10920

( * ) Notice: Subject to any disclaimer, the term of this patent is extended or adjusted under 35 U.S.C. 154(b) by 23 days.

(21) Appl. No.: 11/138,126

(22) Filed: May 26, 2005

(51) Int. Cl.

| | |
|---|---|
| ***G04B 47/00*** | (2006.01) |
| ***G04B 37/00*** | (2006.01) |
| ***A44C 5/00*** | (2006.01) |
| ***G08B 23/00*** | (2006.01) |
| ***B67D 5/64*** | (2006.01) |

(52) U.S. Cl. ..... 368/10; 368/12; 368/281; 368/282; 222/3; 222/80; 222/175; 340/573.1

(58) Field of Classification Search ..... 368/10, 368/11, 12, 47, 223, 281, 282; 222/3, 80, 222/175; 340/573.1
See application file for complete search history.

(56) References Cited

U.S. PATENT DOCUMENTS

| | | | | |
|---|---|---|---|---|
| 5,476,192 | A | 12/1995 | Julinot | |
| 5,652,570 | A | 7/1997 | Lepkofker | |
| 5,663,932 | A * | 9/1997 | Weng | 368/10 |
| 5,742,233 | A | 4/1998 | Hoffman et al. | |
| 5,815,467 | A * | 9/1998 | Deering | 368/10 |
| 5,852,401 | A | 12/1998 | Kita | |
| 5,905,461 | A | 5/1999 | Neher | |
| 6,285,289 | B1 * | 9/2001 | Thornblad | 340/628 |
| 6,412,976 | B1 * | 7/2002 | Dechery et al. | 368/281 |

* cited by examiner

*Primary Examiner*—Vit W. Miska
(74) *Attorney, Agent, or Firm*—Lawrence J. Gibney, Jr.

(57) ABSTRACT

This is a watch which allows a person to be tracked by the global positioning system and also incorporates safety features to protect an individual in the event of danger.

7 Claims, 3 Drawing Sheets

METHOD TO TRACK USING A LOCATOR DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This device allows an individual to track an individual and allows the individual to be located if necessary. Although many types of housings can be used, a watch is depicted in this example. Other types of devices may include key chains and remote control finders to name a few examples. The watch will also be provided with certain security features including a means to spray an airborne irritant such as pepper spray or mace in the event that the security of the individual is threatened.

Additionally, it will also have medical information stored in the watch band which may be available in the case of an emergency.

B. Prior Art

There are other examples of being able to track individuals using various devices and incorporating the global positioning satellite system. Examples of this type are Neagr, U.S. Pat. No. 5,905,461, Hoffman U.S. Pat. No. 5,742,223.

While these devices achieve some of the results of this particular device, they do not achieve all the results and do not incorporate all the features of the current device. The current device in addition to being able to track an individual, will also have medical information and a means to discharge an airborne irritant in the event of danger to the person.

BRIEF SUMMARY OF THE INVENTION

This device is in the general shape of a watch. However, this watch is different in that it has a multitude of features not common to most watches. The shape of the device may also be another device such as a key chain holder. For purposes of this application a watch will be described.

The watch will have medical information encrypted in a band on the back side so that in the event of an emergency, medical information can easily be gathered about the individual. An indicator on the front of the watch will advise medical personnel to look at the band, which is located on the back surface.

On the front side of the watch will be a device to eject a predetermined amount of pepper spray or mace in the event of a security situation. A means to puncture a canister of pepper spray will be incorporated into the watch.

Additionally, the watch will be equipped with a speaker as well as a microphone so that the person can verbally communicate, if that individual is being tracked or the individual is in danger. An antenna will be embedded in the watchband to allow an individual to be tracked and for the individual to communicate. A GPS (Global Positioning System) indicator is also located on the device for tracking from a remote location. A locator button will activate this particular GPS indicator. An audio alarm as well as a voice chip button are also provided in addition to all the previously mentioned features. This watch will operate like any other watch and tell time. A date will be displayed on the watch face as well as a "steps taken" indicator and speed indicator.

It is an object of this device to make a security device in the form of a commonly used item such as a watch with a multitude of safety features in addition to providing time for an individual.

DETAILED DESCRIPTION OF THE EMBODIMENT

Figure 1:
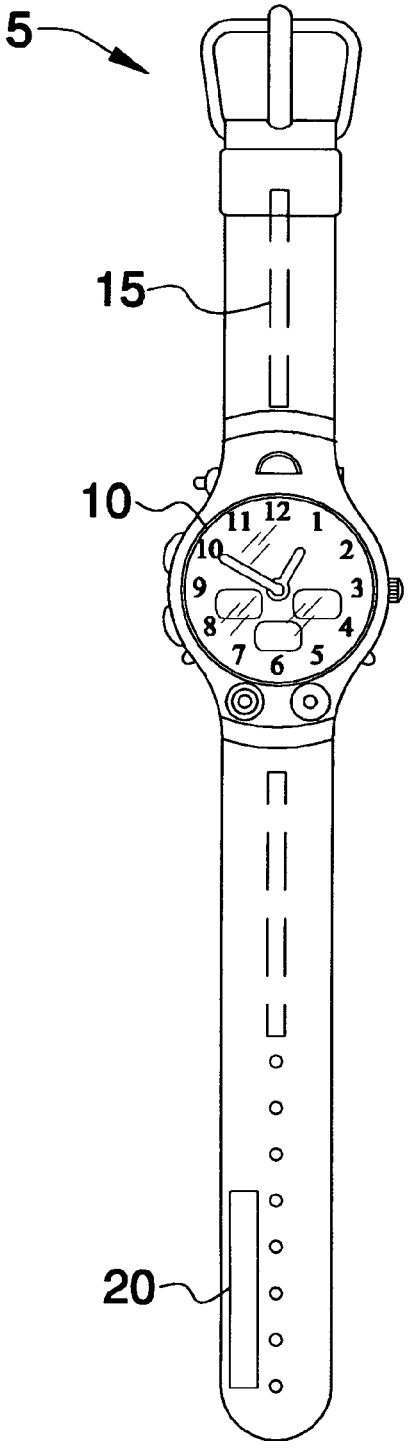
FIG. 1 front view of the device.
Figure 2:
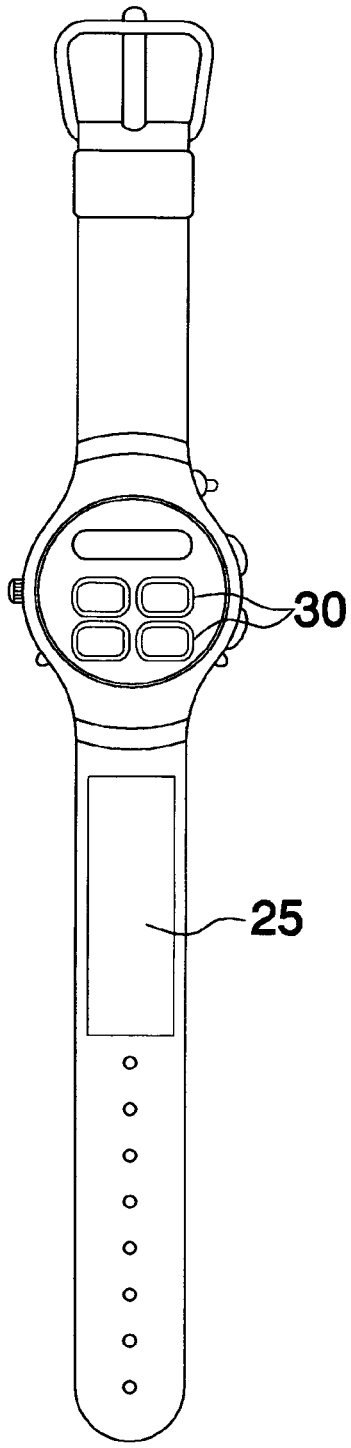
FIG. 2 is a rear view of the device.

This device 5 has the appearance of a watch. However, this watch, while being a watch, also has several unique features. The watch itself will have a watch face 10 which is common to most watches and will operate like any other watch. The watch is secured to the person with a band that is common to all watches, see FIGS. 1,2.

An antenna 15 will be installed in the watch band which will allow an individual to track someone using the Global Positioning System (GPS) or the cellular network. The GPS system or cellular network is not claimed as part of this device but is essential to the operation of the device 5. A chip 85 in the watch will allow the GPS system to locate an individual.

A locator button 80 on the device 5 will allow an individual to send an alarm to a remote location in the event of danger. An audio alarm 90 will also be installed on the watch so that if the individual is in trouble it will have the capacity to sound an alarm to deter a predator, see FIG. 3.

This device will have the normal appearance of a watch including hand dials and a knob 50 to adjust the hand dials. As an additional feature the device 5 will be equipped with a medical strip 25, with encoded medical information on the back of the watch band, see FIG. 2. A notice strip 20 on the front of the device will direct the person to the medical strip 25 on the back, see FIG. 1,2. This is important in the event of an emergency so that the emergency personnel can gain easy access to vital and necessary medical information.

Figure 3:
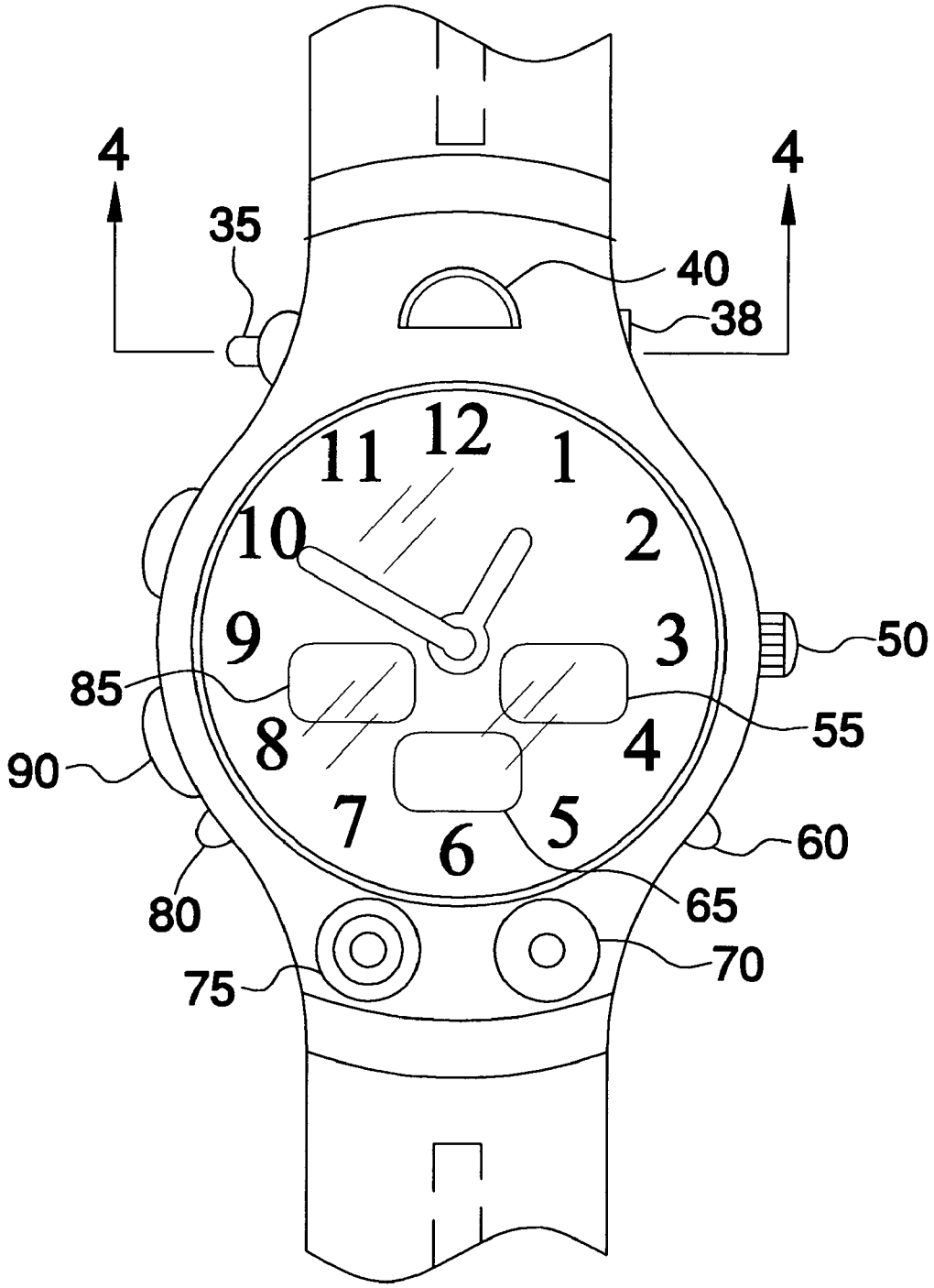
FIG. 3 is a fragmented front view of the device.
Figure 5:
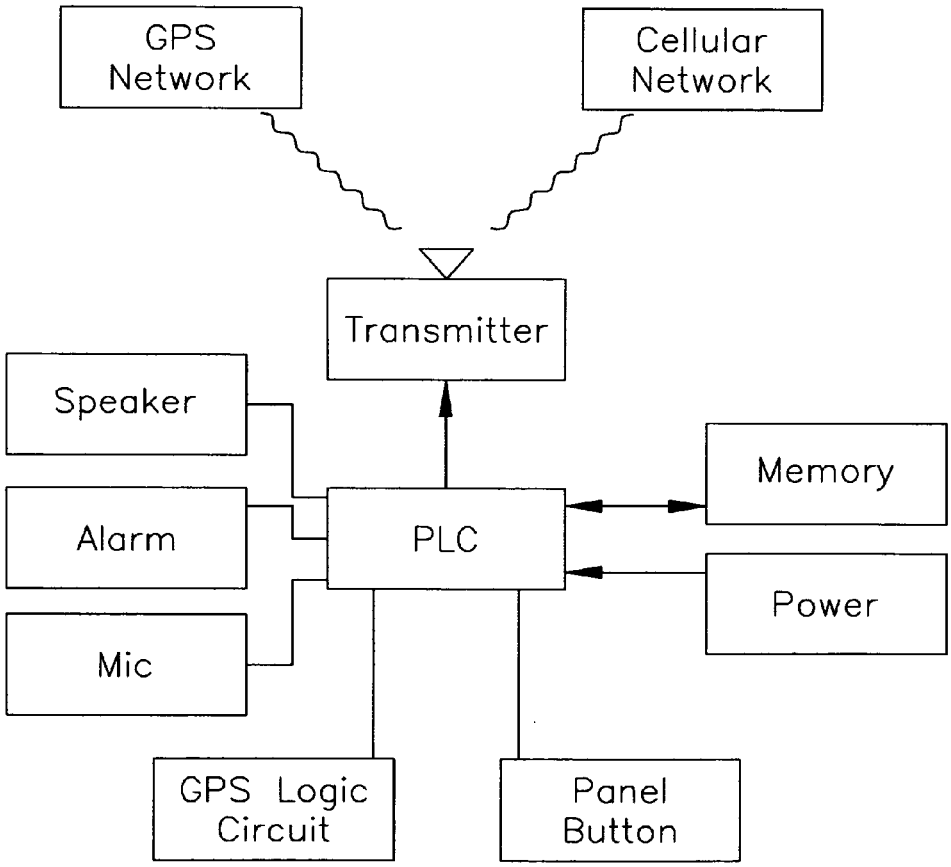
FIG. 5 is schematic of the device.

The device may also be equipped with a voice chip button 60, a date window 65, a microphone 70, and a speaker 75, see FIGS. 3, 5.

The device will also have a "steps taken" window 55, which will assist the individual in the event of an emergency situation in order to allow a person to be tracked to a specific location. Although the device employs the GPS and cellular networks, they are not claimed as part of this examination.

Additionally, the device will have certain presets 30 and controls for a particular individual so that the person can custom fit or custom make specific commands or specific requests. This may include audible reminders of certain events such as alarms and these types of presets 30 are found in watches today.

Figure 4:
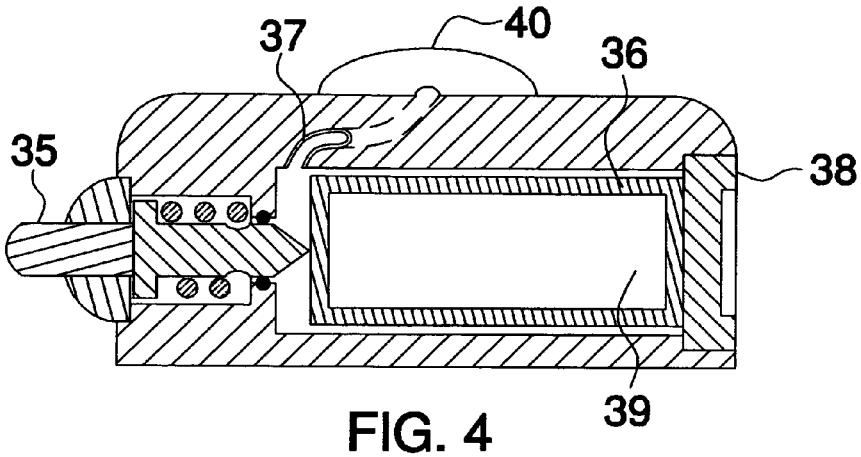
FIG. 4 is a view according to line 4—4 on FIG. 3.

To provide additional protection the device 5 will also have a canister 36 inserted into a cavity in the front end of the watch, see FIG. 4. This canister 36 could contain pepper spray or mace 39 to protect an individual. The canister 36 of pepper spray is secured to the device with a locking means 38. The locking means 38 also allows the canister 36 to be changed and may include a screw, plug or cap.

To discharge the contents of the canister 36, a button 35 on the outside surface of the device 5 is depressed which allows a tapered point to puncture the shell of the canister 36 and allow the spray to be ejected through a connecting tube 37 and an opening 40 on the outside surface of the watch, see FIG. 4.

The invention claimed is:

1. A watch with additional features, which is comprised of:

a. watch;

wherein the watch has a face with numbers and hands to indicate time;

b. band;

wherein the band secures the watch to the user;

c. a notice strip;

wherein the notice strip is placed on the outside of the band;

wherein the notice strip directs the person to a medical strip on the back of the band;

d. a medical strip;

wherein a medical strip is positioned on the back surface of the band;

wherein the medical strip contains encoded medical information for the individual;

e. presets;

wherein certain reminders may be preset by the user;

f. canister;

wherein a canister is embedded in a cavity which is placed on the watchband;

wherein a means to puncture the canister is provided;

wherein a tube provides an outlet for the contents of the canister;

wherein an opening for the canister to the outside is provided;

wherein a locking means for the canister is provided;

g. antenna;

wherein an antenna is embedded in the band of the watch;

wherein the antenna provides a means to locate the person;

h. a speaker;

i. a microphone;

j. voice chip button;

k. steps taken indicator;

wherein the steps taken indicator allows tracking to specific locations for the individual;

l. locator button;

m. a means to access the canister.

2. The watch in claim 1, wherein said canister.

3. The watch in claim 1, wherein said canister spray.

4. The watch in claim 1, wherein said means to access the canister is a screw.

5. The watch in claim 1, wherein said means to access the canister is a plug.

6. The watch in claim 1, wherein said means to locate the person employs the Global Positioning System.

7. The watch in claim 1, wherein said means to locate the person employs a cellular network.

* * * * *